US010777948B2

(12) United States Patent
Thaker

(10) Patent No.: US 10,777,948 B2
(45) Date of Patent: Sep. 15, 2020

(54) MODULAR EXTENDABLE OUTLET ASSEMBLY

(71) Applicant: Nishant Thaker, Coral Springs, FL (US)

(72) Inventor: Nishant Thaker, Coral Springs, FL (US)

( * ) Notice: Subject to any disclaimer, the term of this patent is extended or adjusted under 35 U.S.C. 154(b) by 0 days.

(21) Appl. No.: 16/457,714

(22) Filed: Jun. 28, 2019

(65) Prior Publication Data

US 2020/0006902 A1 Jan. 2, 2020

Related U.S. Application Data

(60) Provisional application No. 62/691,523, filed on Jun. 28, 2018.

(51) Int. Cl.

| | |
|---|---|
| ***H01R 13/72*** | (2006.01) |
| ***H01R 13/717*** | (2006.01) |
| ***H01R 25/00*** | (2006.01) |
| ***H01R 13/70*** | (2006.01) |
| ***H01R 13/514*** | (2006.01) |
| ***H01R 27/02*** | (2006.01) |

(52) U.S. Cl.

CPC ..... *H01R 13/72* (2013.01); *H01R 13/514* (2013.01); *H01R 13/70* (2013.01); *H01R 13/717* (2013.01); *H01R 25/006* (2013.01); *H01R 27/02* (2013.01)

(58) Field of Classification Search

CPC ..... H02G 11/02
USPC ..... 4/4, 501
See application file for complete search history.

(56) References Cited

U.S. PATENT DOCUMENTS

| | | | | |
|---|---|---|---|---|
| 2,979,576 A * | 4/1961 | Huber | H02G 11/02 | 191/12.4 |
| 3,296,387 A * | 1/1967 | Le Baigue | H01R 13/72 | 191/12.4 |
| 4,520,239 A * | 5/1985 | Schwartz | H02G 11/02 | 191/12.4 |
| 4,842,108 A | 6/1989 | Anderson et al. | | |
| 5,334,033 A | 8/1994 | Milan | | |
| 5,383,799 A * | 1/1995 | Fladung | H01R 25/006 | 439/108 |
| 5,562,488 A | 10/1996 | Neiser et al. | | |

(Continued)

*Primary Examiner* — Neil Abrams
(74) *Attorney, Agent, or Firm* — Mark C. Johnson; Johnson Dalal

(57) ABSTRACT

A modular extendable outlet assembly comprises multiple selectively removably couplable outlet units. The units comprise an electrical housing with a first end, a second end opposing the first end, a visible front face having a first electrical socket, a rear face having a mount wall with holes, and a sidewall enclosing a unit cavity. An electrical plug retractably extends from the second end of housing. The electrical plug has an electrical prong configuration corresponding to a prong configuration of the second electrical socket to mate with an adjacent outlet unit. A spool assembly disposed within the unit cavity operates with a spring-loaded spool member. An electrical cord wraps around the spring-loaded spool member, terminating at the electrical plug. A cord release switch selectively translates the spring-loaded spool member to rotate and extend in length, the electrical cord. A unit activation switch electrically couples to the first electrical socket for powering.

20 Claims, 6 Drawing Sheets

(56) References Cited

U.S. PATENT DOCUMENTS 5,658,158 A * 8/1997 Milan ..... H01R 13/514 439/214
5,679,925 A * 10/1997 Dilley ..... H01R 13/72 174/53
5,700,158 A 12/1997 Neiser et al.
5,701,981 A 12/1997 Marshall et al.
5,885,109 A * 3/1999 Lee ..... H01R 13/514 439/131
6,035,983 A * 3/2000 Benner ..... B65H 75/38 191/12.2 R
6,087,587 A 7/2000 Gonzalez
6,369,999 B1 * 4/2002 Wohlgemuth ..... H01R 33/95 361/111
6,574,120 B1 * 6/2003 Chou ..... H02G 11/02 200/52 R
6,623,294 B2 * 9/2003 Tse ..... H01R 13/72 439/174
6,875,051 B2 * 4/2005 Pizak ..... H01R 25/003 439/501
7,210,960 B2 * 5/2007 Mak ..... H01R 13/504 439/505
7,758,376 B2 7/2010 Hwang et al.
7,845,975 B2 12/2010 Yue et al.
7,874,856 B1 1/2011 Schriefer et al.
7,959,444 B2 * 6/2011 Corless ..... H01R 13/72 439/4
8,014,170 B2 * 9/2011 Mori ..... F16L 3/13 174/53
8,544,623 B1 * 10/2013 Murphy ..... H02G 11/02 191/12.4
8,905,780 B2 12/2014 Vallon et al.
9,136,684 B2 * 9/2015 Giles ..... H02G 11/02
9,147,985 B1 9/2015 Noriega
9,794,496 B2 * 10/2017 Soffer ..... H04N 5/268
9,912,154 B2 * 3/2018 Fleisig ..... H01R 13/72
10,396,515 B2 * 8/2019 Nauertz ..... H02J 7/0054
10,516,258 B2 * 12/2019 Ebrahimi Afrouzi ..... H05K 5/0004
2010/0261376 A1 * 10/2010 Hwang ..... H01R 13/60 439/501
2012/0028505 A1 * 2/2012 Weber ..... H01R 25/003 439/638
2018/0062331 A1 3/2018 Finn et al.
2020/0006902 A1 * 1/2020 Thaker ..... H01R 13/7039

* cited by examiner

MODULAR EXTENDABLE OUTLET ASSEMBLY

CROSS-REFERENCE TO RELATED APPLICATION

This application claims priority to U.S. Provisional Patent Application No. 62/691,523 filed Jun. 28, 2019, the entirety of which is incorporated by reference.

FIELD OF THE INVENTION

The present invention relates generally to outlet extensions, and, more particularly, relates to modular extendable outlet extensions that provide and extend power from a convention wall outlet or other power source

BACKGROUND OF THE INVENTION

Typically, an electrical outlet is a socket that connects an electrical device to a supply of electricity. Most electoral sockets are installed in the wall, or floor, or even ceiling. A power cord terminates at a plug that mates with the electrical socket. The power cord temporarily connects an electrical device to the electrical socket, so as to supply a current thereto. In most electrical outlets, the female electrical sockets are oriented in a fixed position. This fixed orientation reduces the flexibility of the electrical outlet. Also, most power cords have a fixed length, and only one plug for connecting to the socket. Further, electrical sockets are not constructed with USB ports for transfer of data or recharging electrical devices, such as smart phones.

Therefore, a need exists to overcome the problems with the prior art as discussed above.

SUMMARY OF THE INVENTION

The invention provides a modular extendable outlet assembly that overcomes the hereinafore-mentioned disadvantages of the heretofore-known devices and methods of this general type and that overcomes known disadvantages of those known devices and methods of this general type and that efficiently and effectively provides and extends power from a convention wall outlet or other power source. The assembly provides a plurality of selectively removably couplable outlet units that detachably couple together to provide myriad combinations of electrical sockets and plugs that can be arranged for complex electrical and data connectivity means. In addition, embodiments of the invention provide an electrical housing having a first electrical socket and a second electrical socket on separate faces of the housing to receive electrical plugs and USB plugs from multiple power and data sources. The assembly enables connectivity for both supplying electricity and transferring data. The assembly also allows a power cord to retract into a housing through a spring-loaded spool assembly, for efficient stowage of the power cord.

With the foregoing and other objects in view, there is provided, in accordance with the invention, a modular extendable outlet assembly comprising a plurality of selectively removably couplable outlet units. Each of the couplable outlet units have an electrical housing with a first end, a second end opposing the first end, a front face, and a rear face opposing the front face. The electrical housing further has a mount wall forming mount holes, and a sidewall enclosing, with the front and rear faces of the electrical housing, a unit cavity.

In some embodiments, the modular extendable outlet assembly comprises a first electrical socket that is defined by and disposed on the front face of the electrical housing. On another section of the electrical housing is a second electrical socket defined by and disposed on the second end of the electrical housing. Further, a plug cord aperture is defined by, and disposed on the first end of the housing.

In another embodiment, a spool assembly is disposed within the unit cavity and with a spring-loaded spool member. An electrical cord is coupled to and wrapped around the spring-loaded spool member. The electrical cord has a portion disposed within the plug cord aperture and including an electrical plug disposed at a terminal end of the electrical cord. The electrical plug has an electrical prong configuration corresponding to a prong configuration of the second electrical socket, and electrically coupled to the first electrical socket and the second electrical socket.

In some embodiments, a cord release switch is disposed on the electrical housing. The cord release switch is operably coupled to the spring-loaded spool member, and operably configured to selectively translate and cause the spring-loaded spool member to rotate and extend in length the electrical cord a distance from the electrical housing. In this manner, each of the plurality of selectively removably couplable outlet units are operably configured to be selectively and independently electrically couplable, extendable, and retractable with respect to one another. In one non-limiting embodiment, the spring-loaded spool member comprises a ratchet wheel, a spring, and a lever that enable linear motion of the electrical cord in one direction.

In accordance with another feature, an embodiment of the present invention includes a unit activation switch electrically couples to the first electrical socket, the second electrical socket, and the electrical plug. Further, the unit activation switch is disposed on the electrical housing and operably configured to selectively translate to a first position closing a circuit with respect to the first electrical socket and at least one of the second electrical socket and the electrical plug. The unit activation switch selectively translates to a second position opening a circuit with respect to the first electrical socket and at least one of the second electrical socket and the electrical plug.

In accordance with another feature, an embodiment of the present invention includes a pair of cantilevered plug fastening members coupled to and extending away from the second end of the electrical housing, the pair of cantilevered plug fastening members flanking the second electrical socket, the pair of cantilevered plug fastening members operably configured to directly couple with the electrical plug.

In accordance with a further feature of the present invention, each of the pair of cantilevered plug fastening members further comprises a flange disposed thereon.

In accordance with a further feature of the present invention, the flange of each of the pair of cantilevered plug fastening members is disposed at the distal end thereof and is of a rounded shape.

In accordance with a further feature of the present invention, the electrical plug on each of the plurality of selectively removably couplable outlet units further comprises an outer perimeter surface surrounding the electrical plug, a first plug end, a second plug end opposing the first plug end, and two plug recesses corresponding in size to one another and the flange of each of the pair of cantilevered plug fastening member and each disposed on first and second plug ends, respectively, of the outer perimeter surface.

In accordance with a further feature of the present invention, the outer perimeter surface surrounding the electrical plug is of a deformably resilient material.

In accordance with a further feature of the present invention, the flange of each of the pair of cantilevered plug fastening members is operably configured to have a plug coupling configuration restricting longitudinal movement of the electrical plug when coupled thereto.

In accordance with a further feature of the present invention, the pair of cantilevered plug fastening members are flexible.

In accordance with a further feature of the present invention, the outer perimeter surface surrounding the electrical plug is of a deformably resilient material.

In accordance with a further feature of the present invention, the cord release switch is disposed on the sidewall of the electrical housing.

In accordance with a further feature of the present invention, the electrical plug on each of the plurality of selectively removably couplable outlet units further comprises a PCB board.

In accordance with a further feature of the present invention, the first face of the electrical housing comprises a USB port.

In accordance with a further feature of the present invention, the electrical plug on each of the plurality of selectively removably couplable outlet units further comprises one or more holes on the rear face of the housing for hanging each individual unit.

In accordance with a further feature of the present invention, an outer perimeter surface surrounding the electrical plug, a first plug end, a second plug end opposing the first plug end, and two plug recesses corresponding in size to one another and the flange of each of the pair of cantilevered plug fastening member and each disposed on first and second plug ends, respectively, of the outer perimeter surface.

In accordance with a further feature of the present invention, the first electrical socket and the second electrical socket comprises a USA standard 3 prong outlet.

In accordance with a further feature of the present invention, the electrical plug comprises a USA standard 3 prong female plug.

In accordance with a further feature of the present invention, the electrical housing is separable into a first housing portion and a second housing portion, the housing portions being detachably attachable through a housing fastening bracket.

Although the invention is illustrated and described herein as embodied in a Modular Extendable Outlet Extension, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the electrical housing. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
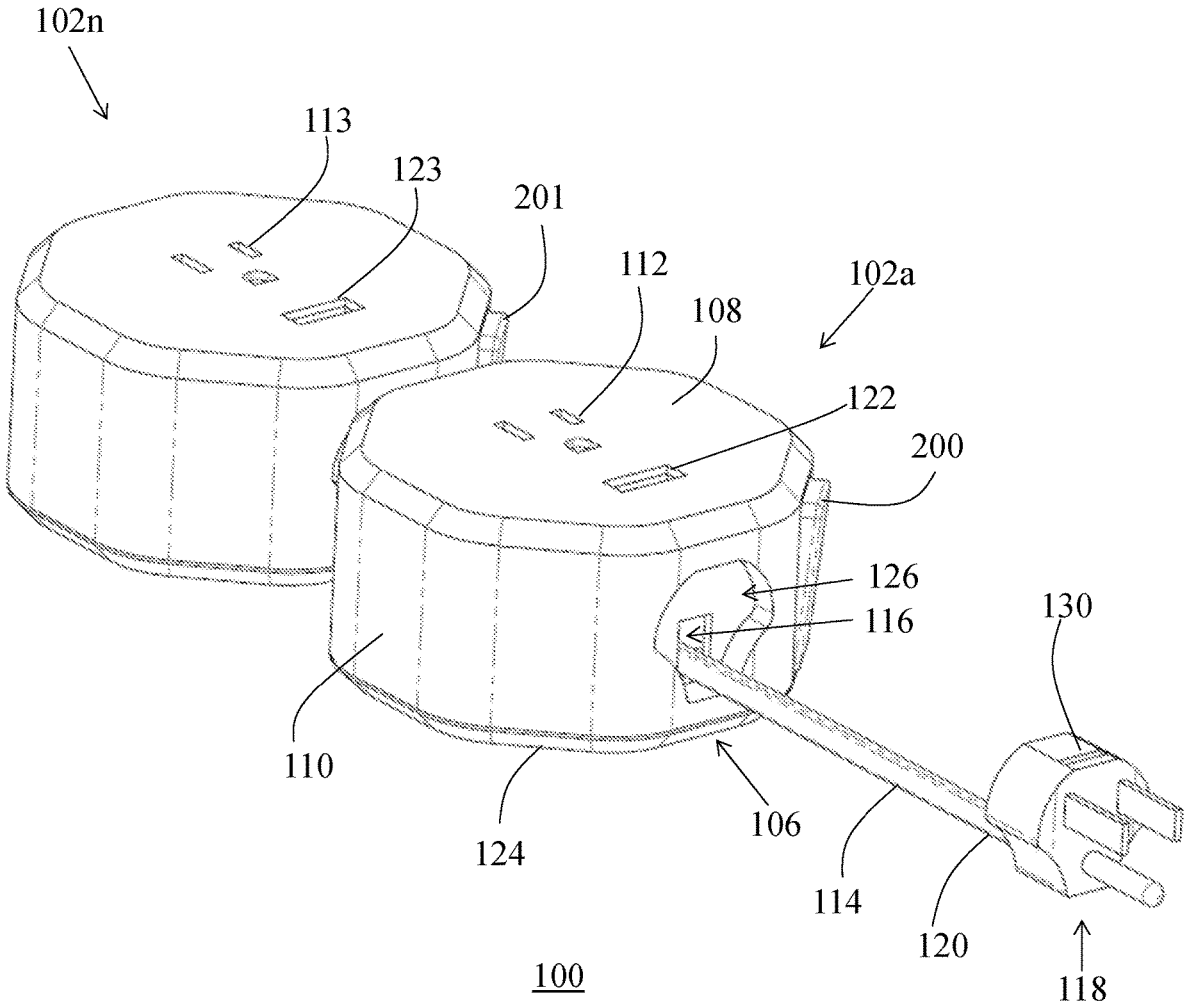
FIG. 1 is a perspective view of an exemplary modular extendable outlet assembly, showing two units operatively coupled together, in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient modular extendable outlet extension that overcomes known disadvantages of those known devices and methods of this general type and that efficiently and effectively provides and extends power from a convention wall outlet or other power source. Embodiments of the invention provide a plurality of selectively removably couplable outlet units that detachably couple together to provide myriad combinations of electrical sockets and plugs that can be arranged for complex electrical and data connectivity means.

In addition, embodiments of the invention provide an electrical housing having a first electrical socket and a second electrical socket on separate faces of the housing to receive electrical plugs and USB plugs from multiple power and data sources. The assembly enables connectivity for both supplying electricity, and transferring data. The assembly also allows a power cord to retract into a housing through a spring-loaded spool assembly, for efficient stowage of the power cord.

Figure 2:
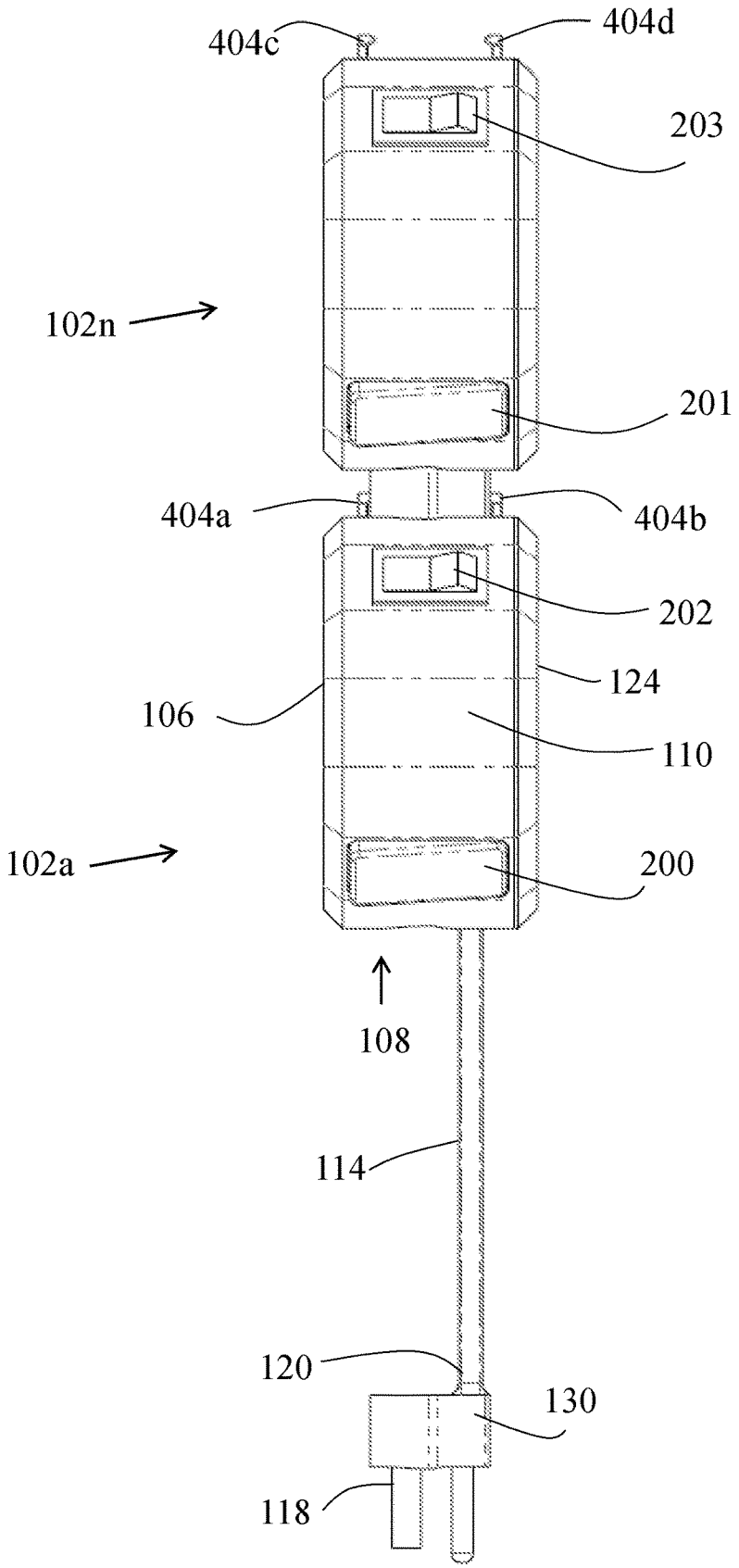
FIG. 2 is a side view of the modular extendable outlet assembly, showing two units operatively coupled together, in accordance with the present invention.

Referring now to FIG. 1, one embodiment of the present invention is shown in an isometric view. FIG. 1 shows several advantageous features of the present invention, but, as will be described below, the invention can be provided in several shapes, sizes, combinations of features and components, and varying numbers and functions of the components. The first example of a modular extendable outlet assembly 100, as shown in FIG. 2, includes a plurality of selectively removably couplable outlet units 102*a-n,* wherein "n" represents any number greater than one. Each of the outlet units 102*a-n* form a modular assembly, with each unit operably configured to be selectively removable by a user or joined together for the desired number of outlets, and at the desired amount of length separating each unit.

The unique, modular arrangement of the outlet units 102*a-n* is possible because the electrical sockets 112, 402 are on different faces, the electrical cord 114 is extendable and retractable, and multiple outlet units 102*a-n* can be detachably mated with each other in different patterns and with different external electrical components. This modular connectivity allows a plurality of selectively removably couplable outlet units that detachably couple together to provide myriad combinations of electrical sockets and plugs that can be arranged for complex electrical and data connectivity means.

For example, multiple couplable outlet units 102*a-n* can be connected in a linear arrangement to create greater length and reach to an electrical outlet. Or the couplable outlet units 102*a-n* can be connected along a path that follows electrical equipment, such as a network of computers, or industrial machines, or tables in a cyber cafe. In either case, the capacity to arrange the couplable outlet units 102*a-n* in series multiplies the power supply effect.

Figure 3:
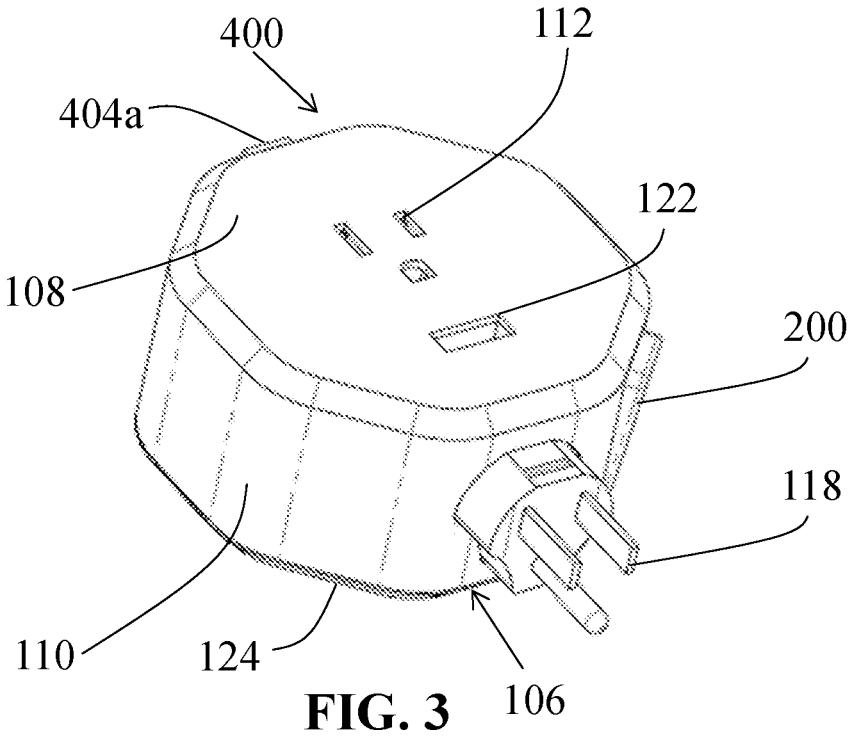
FIG. 3 is a front perspective view of the modular extendable outlet assembly, showing the front face with first electrical socket and an electric plug retracted into the plug recess, in accordance with the present invention.

Referring to FIG. 3, each couplable outlet unit 102*a-n* includes an electrical housing 104 that serves as the foundation for the outlet units 102*a-n.* The electrical housing has a first end 106 and a second end 300 that opposes the first end 106. The ends 106, 300 are oriented along the longitudinal of the electrical housing 104. As described below, the ends 106, 300 are interconnected in a longitudinal series through an electrical cord 114 terminating an electrical plug 118, and mating with a first electrical socket 112 of an adjacent electrical housing. This creates a linear continuity of electrical outlets that can be arranged in myriad combinations, directions, and mated with eclectic electrical components, or simply mated together for enlarging electrical outlet capacity.

Figure 4:
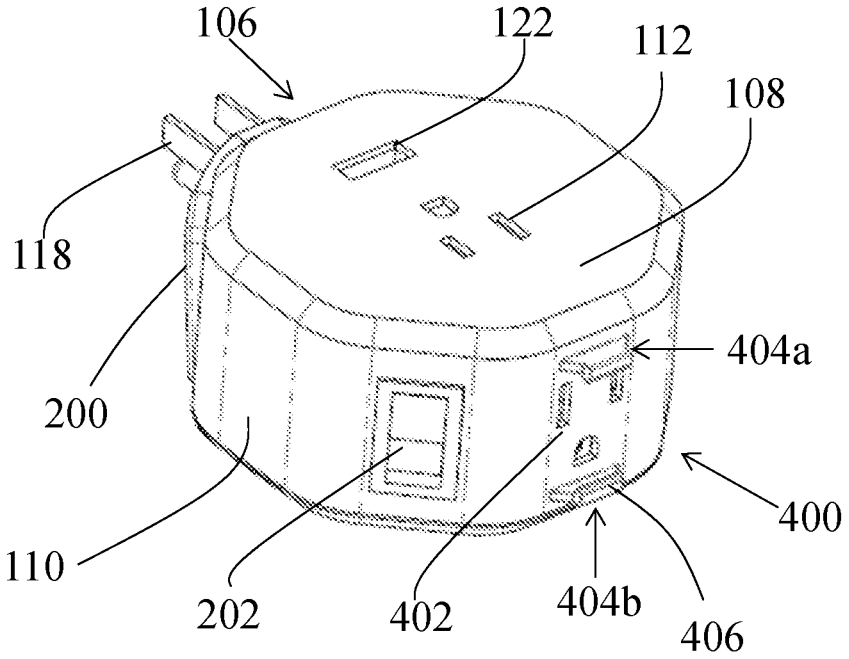
FIG. 4 is a rear perspective view of the modular extendable outlet assembly, showing the front face with first electrical socket and an electric plug retracted into the plug recess, in accordance with the present invention.

As shown in FIG. 4, the electrical housing 104 also has a front face 108, and a rear face 700 that may oppose the front face 108. The front face 108 is configured to face outwardly, so as to be visible and accessible for mating with corresponding electrical plugs, USB port 122, and the like. In this manner, the assembly enables connectivity for both supplying electricity (socket), and transferring data (USB port). In addition to these functions, the electrical housing 104 further includes a mount wall 124 and sidewalls 110 that may continuously surround and couple to the front and rear faces 108, 700 (also referred to as "walls").

The rear face 700 of the housing for each modular unit 102*a-n* is the face that is not visible, and often mounted to a surface, or resting on the ground. In some embodiments, the rear face 700 may be substantially planar and define wall-hanging apertures or recesses shaped and sized to receive a fastener, e.g., screw. The mount wall 124 is configured to mount the outlet unit 102*a* to a surface. To assist in these mounting functions, the mount wall 124 may form one or more holes 702*a,* 702*b* for hanging each individual outlet unit 102*a-n* (FIG. 7) In one non-limiting embodiment, the holes 702*a-b* have a round shape with a slot extending from one end. This unique shape allows the holes 702*a-b* to receive a peg or other linear mounting surface through the slot, and then slidably receive the peg into the round hole for a secure mount. In an alternative embodiment, the mount wall 124 is coated with an adhesive to enable mounting the housing 104 to a flat mounting surface, either vertically or horizontally.

The electrical housing 104 is sized and dimensioned to encapsulate the electrical components employed to transfer power/electricity from the conventional wall outlet, for example, to each individual unit(s). In some embodiments, the electrical housing 104 may have rounded corners to prevent snagging objects. Such rounded edges and corners may be useful in an office environment, where skirts, pant suits, wires, and desks are moving near the electrical housing 104.

Figure 6:
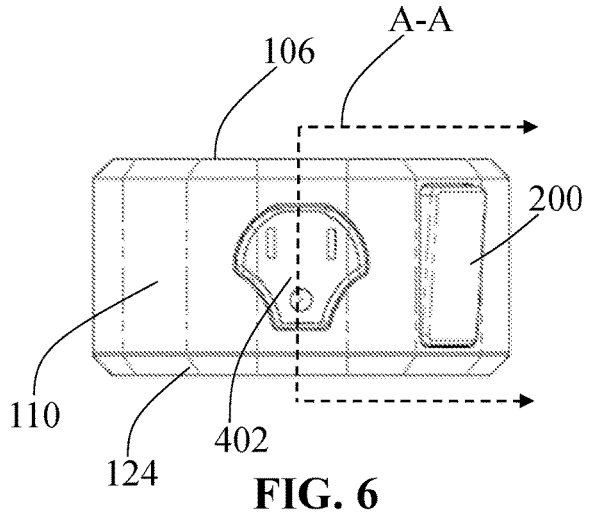
FIG. 6 is a frontal view of the electrical housing of the modular extendable outlet assembly, showing the rear face, in accordance with the present invention.

As illustrated in FIG. 6, the sidewalls may be flat and/or protrusion-free, other than recesses employed to effectuate use of the module unit, e.g., a switch to engage with or retract the plugs. While the electrical housing 104 of each unit is depicted as octagonal with a diameter of approximately 3-6 inches, the shape and size may vary based on design constraints or applications. In one non-limiting embodiment, the front face 108 follows an octagonal shape. However, other shapes may also be used.

Figure 5:
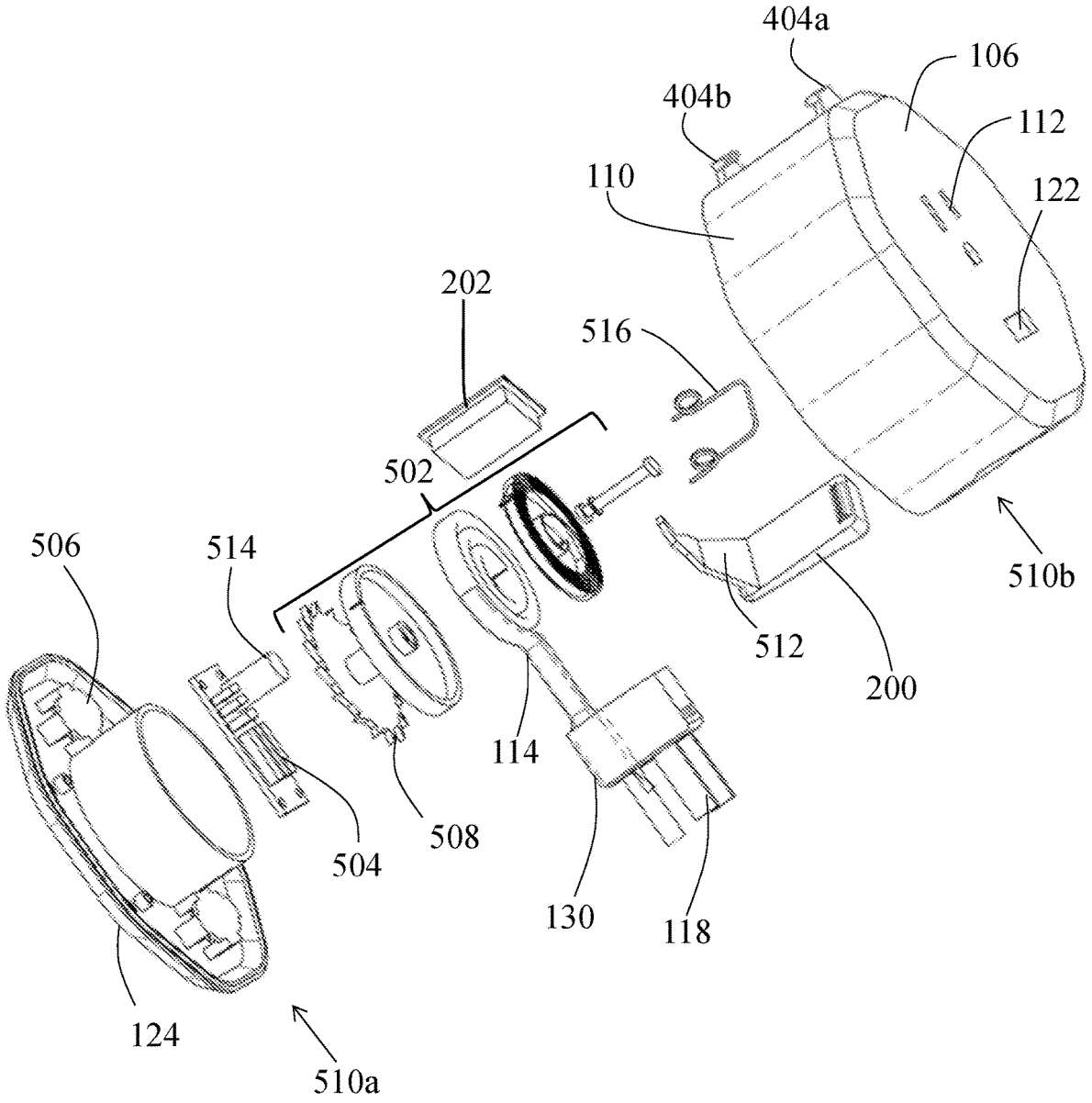
FIG. 5 is a blow-up view of the modular extendable outlet assembly, showing the internal components, in accordance with the present invention.

In one embodiment shown in FIG. 5, the electrical housing 104 is separable into a first housing portion 510*a* and a second housing portion 510*b*. The housing portions are detachably attachable through a housing fastening bracket 506. The separation of the housing 104 may be possible due to a friction snap-fit relationship between the separate portions. Each portion may have an equal size. In some embodiments, the first portion 510*a* is the rear face 700, and smaller than second portion 510*b*, which can include the sidewall 110 and front face 108.

In some embodiments, all or part of electrical housing 104 may be of a plastic material, or other polymer-based material. In other embodiments, all or a portion of the housing may be made of other materials, but is preferably of a relatively rigid, low cost, non-electrically conductive material, and generally is operable to shield the internal components from the external environment, i.e., encapsulate.

Figure 7:
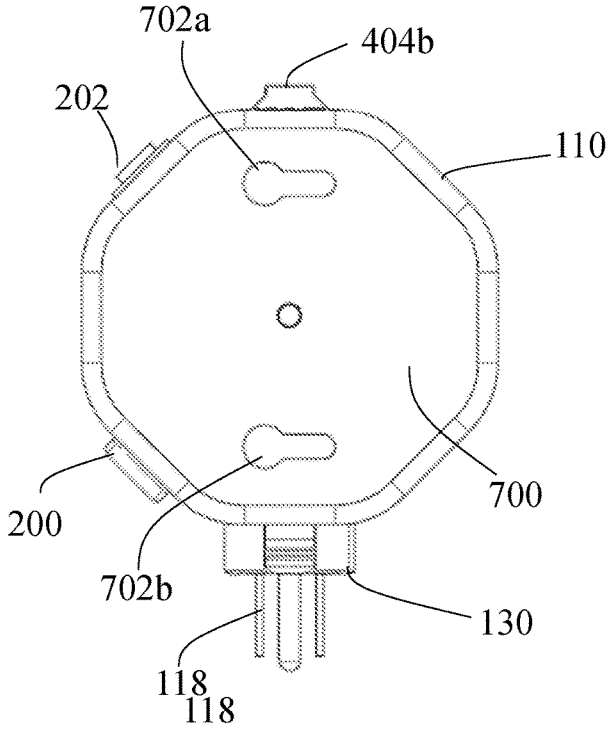
FIG. 7 is a rear view of the electrical housing of the modular extendable outlet assembly, showing the mount wall, in accordance with the present invention.

It should be understood that terms such as, "front," "rear," "side," top," "bottom," and the like are indicated from the reference point of a viewer viewing the unitary wall outlet charging station 100 from its front wall 104 when the electrical plug is plugged into the first and second electrical sockets 112, 402 disposed on the electrical housing 104 (see FIG. 7). As used herein, the term "wall" is intended broadly to encompass continuous structures, as well as, separate structures that are coupled together so as to form a substantially continuous external surface.

Figure 8:
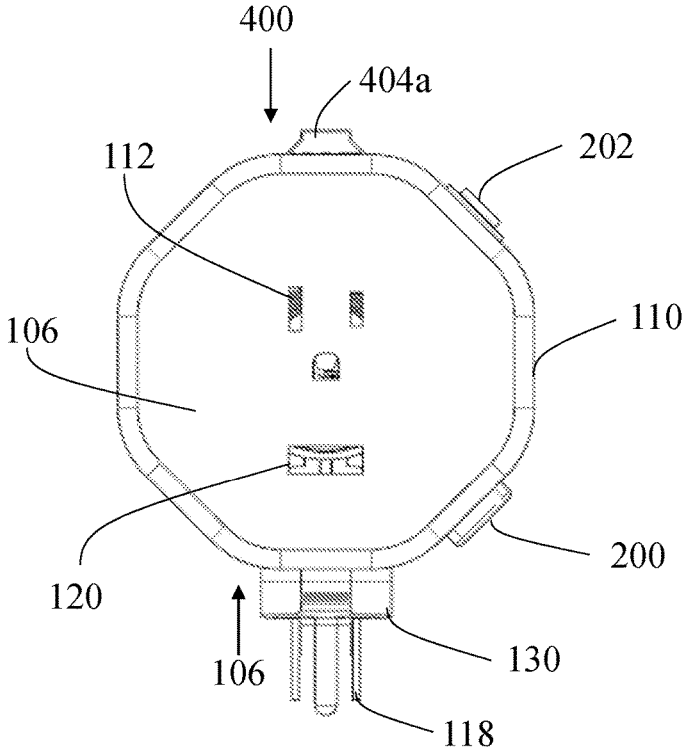
FIG. 8 is a top view of the electrical housing of the modular extendable outlet assembly, showing the mount wall, in accordance with the present invention.

Turning now to FIG. 8, the front face 108 of the housing 104 for each module unit is the face that is visible and accessible for mating with different power and data transfer plugs/cords. The front face 108 includes a first electrical socket 112, and as plug recesses 126 that are adapted to resemble a standard wall outlet faceplate. The front face 108 also supports a USB port 122 and/or other electrical or data socketing mechanisms known in the art. As shown back in FIG. 1, subsequent outlet units 102*n* may also include a subsequent USB port 123 on the front face, as shown in the first outlet unit 102*a*. In one non-limiting embodiment, the first electrical socket 112 comprises a USA standard 3 prong outlet. In another embodiment, a standard USB port forms in the front face 108. The electricity from a power source flows through the housing through a circuitry to the first electrical socket 112 and the USB port 122. In one additional embodiment, each modular unit 102*a* will also include an AC-to-DC converter 514 in order to convert AC power to DC power, e.g., to power the USB port 122. In an alternative embodiment, the modular unit assembly may not include an AC-to-DC converter.

Figure 10:
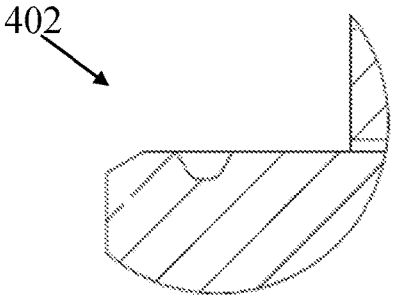
FIG. 10 is a side view of a portion of the first electrical socket, in accordance with the present invention.

Similarly, the second end 400 of the electrical housing 104 has a second electrical socket 402 (shown in FIG. 10). The second electrical socket 402 is substantially the same as the first electrical socket 112 in functionality for receiving an electrical plug, but on a different wall of the housing 104. For example, the second electrical socket 402 is disposed on the second end 400 of the housing 104, oriented 90° away from the first electrical socket 112 on the front face 108 of the housing 104. In one alternative embodiment, a third or fourth electrical socket (not shown) can also be operational on any of the other faces/walls of the housing 104. As with the first and second electrical sockets 112, 402, such additional electrical sockets allow for greater combinations of electrical and data connectivity with other outlet units and/or external electrical devices.

Figure 11:
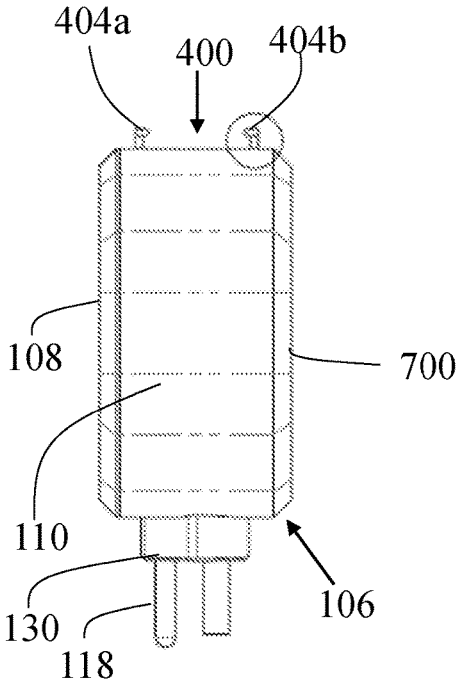
FIG. 11 is a side view of the housing, showing the electric plug retracted into the recess, in accordance with the present invention.

The first end 106 of each module unit 102*a* may include an electrical plug 118. For example, FIG. 11 is a side view of the housing, showing the electric plug retracted into the recess. In one non-limiting embodiment, the electrical plug 118 comprises a USA standard 3 prong female plug. However, other types of electrical plugs known in the art may also be used. The electrical plug 118 is configured to receive and electrically communicate with prongs/plugs disposed at the second end 400 of an adjacent modular unit 102*n*. Thus, the orientation of the first electrical socket 112 in relation to the outlet plug recesses 126 on the first end 106 of the housing 104 allows for a modular mating arrangement between multiple couplable outlet units 102*a-n*. This creates a series of n-units that carry the same electrical current or data packets in series.

The electrical plug 118 is extendable and retractable with respect to the electrical housing 104 through an electrical cord 114. Once extended, the electrical plug 118 removably can couple to conventional wall outlets, as generally known to those of skill in the art, because most residential and commercial units, homes, etc. have several in each room. However, due to the multi-faceted configuration involving electrical sockets 112, 402, the electrical plug 118 also has the functionality to removably couple to an adjacent couplable outlet unit 102*a-n*. In some embodiments, a plug cord aperture 116 is disposed on the first end 106 of the housing 104 to enable passage (retraction/extension) of the electrical cord 114.

In one embodiment, each individual modular unit 102*a-n* may be operably configured to extend the electrical cord 114 a maximum length range of approximately 6"-32", thereby providing an assembled modular unit operably that easily extends to a desired length dictated by how many modular units are part of the assembled modular unit assembly 102*a-n*. In other embodiments, each modular unit may extend other distances. For example, the assembly 100 may include modular units sold in varying maximum extendable lengths or as one standard maximum extension length. The electrical cord and plug on each unit are also operably configured to retract using, for example, a spring-based reel assembly housed within each unit.

In operation, the user would plug the electrical plug 118 disposed at a first end 106 of the assembled modular unit(s) into the conventional electrical outlet(s). The second end 400 of the assembled modular unit 102*a* may then be extended through independently extending intermediate modular unit(s) or the unit 102*n* disposed at the second end 400 of the assembled modular unit.

The electrical plug 118 may include a three (3) prong plug referred to as a Type B electrical outlet plug according to the U.S. Department of Commerce International Trade Administration (USDCITA), which is a standard power outlet plug in the United States of America, as is known generally in the art. In other embodiments, the plug recesses may be operable to receive and/prongs may be formed as a two-prong plug referred to as a Type B electrical outlet plug by the USDCITA, or other plugs configurations that may be standard in various different countries (e.g., Type C used commonly in Europe, Type D used commonly in India, Type E used commonly in France and other European countries, Type F used commonly in Russia, Types G through Type O, and the like.

An electrical cord 114 is used to electrically couple the electrical plug 118, disposed at the terminal end 120 of each modular unit to the first electrical socket 112. The electrical cord 114 may be any type of conductor, cable, cord, etc. operable to transmit power. In a retracted configuration thereof, an exemplary embodiment of which is shown in FIG. 2, the cord 114 and plug 118 are disposed at least partially within a cavity of each electrical housing 104 so as to be visually concealed within the electrical housing 104.

As used herein, the term "visually concealed" means entirely visually concealed or substantially visually concealed when viewed in a top plan view. As used herein, the phrase "retracted configuration" is intended to indicate a configuration of the respective retractable cable in which the retractable cable is retracted/withdrawn into the housing of each modular unit along a cable translation path for visual and physical concealment when the corresponding connector is not desired to be in use to connect with another modular unit. When in the retracted position, each housing of the modular unit is configured to be substantially adjacent to or directly coupled with a neighboring housing.

Figure 9:
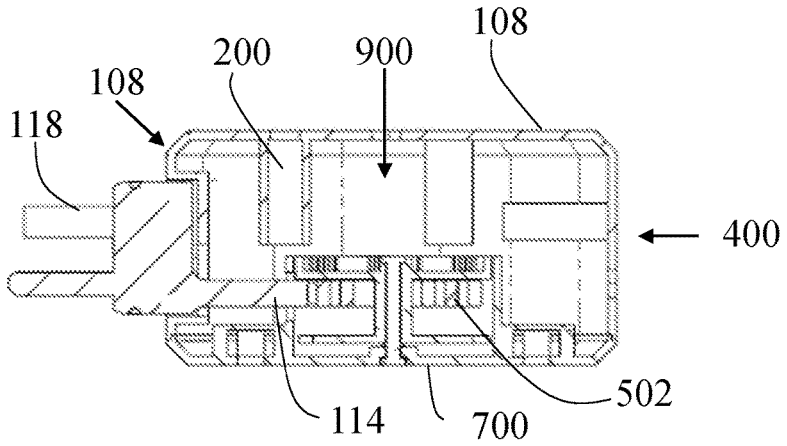
FIG. 9 is a sectioned side view of the electrical housing of the modular extendable outlet assembly, the section taken along section A-A of FIG. 6, detailing the internal components, in accordance with the present invention.

As the sectioned view of FIG. 9 illustrates, the assembly also allows the electrical cord 114 to retract into the unit cavity 900 of the electrical housing 104 through a spring-loaded spool member 500, for efficient stowage of the electrical cord 114. In some embodiments, a cord release switch 200 is disposed on the electrical housing 104. The cord release switch 200 is operably coupled to the spring-loaded spool member 500, and operably configured to selectively translate and cause the spring-loaded spool member to rotate and extend in length the electrical cord a distance from the electrical housing 104. When multiple outlet units 102*a-n* are used, a second cord release switch 201 is operable on the second outlet unit 102*n*.

In this manner, each of the plurality of selectively removably couplable outlet units are operably configured to be selectively and independently electrically couplable, extendable, and retractable with respect to one another. In one non-limiting embodiment, the spring-loaded spool member 500 comprises a ratchet wheel 508, a spring 516, and a lever 512 that enable linear motion of the electrical cord in one direction. The rotational articulation of the ratchet wheel 508 is biased to retract the electrical cord 114 into the unit cavity 900 of the electrical housing 104. The lever 512 restricts motion of the ratchet wheel 508 in one direction, until released by a release switch 200, as described below.

The plug recesses 126 in the first electrical socket 112 may be operable to receive the electrical plug 118 or prong that are employed with the modular outlet assembly. In one embodiment, one of the sidewall faces or ends from which the electrical plug 118 extends may define two plug recesses 126. The plug recesses 126 may be sized so that at least a portion of the plug may be disposed within the plug recesses 126 in the retracted configuration thereof. As used herein, the term "recess" is intended to indicate a space provided by a sidewall that is set further back from the rest of the sidewall.

In a further embodiment, the plug recesses 126 are sized and shaped to receive at least one finger of the user so as to permit the user to grip the plug in order to apply a pulling force to outwardly extend the retractable cable in a longitudinal direction. In other embodiments, the plug recesses 126 may be sized and shaped to receive two fingers of the user so as to permit the user to grip the plug in order to outwardly extend the plug/cable. In yet another embodiment, the sidewall may be substantially planar/flat without a recess and may instead provide for at least a portion of the plug to protrude from the sidewall.

Alternatively, in an extended configuration along the respective cable path, an exemplary embodiment of which is shown in FIG. 1, one or more of the cables are increased in length by, for example, pulling on the plug outwardly into an external environment or an adjacent modular unit with the plug coupled thereto. The length of the electrical cable 114 may be selectively adjustable in distance from a respective sidewall of the housing. In one embodiment, the cable may only be adjusted through use of a switch that requires depression before the cable can be extended and/or retracted.

In other embodiments, the electrical cable 114 may be unwrapped around one or more specifically designed retention portions of the housing, as seen in other figures. Internally or externally within the housing, the cable may be rotating about a reel axis from which the electrical cable 114 is rotated onto or from. As used herein, the term "cable path" is intended to indicate a path that a respective retractable cable travels during retraction and/or extension thereof respective to the housing of each respective modular unit.

Looking again at FIG. 5, a first spool is provided within the cavity of the housing to implement the retractable functionality of the electrical ca. As is known in the art, a spool may be considered a cylindrical device on which the retractable cable may be wound and unwound. In other embodiments, the retractable functionality may be provided through other apparatuses and methods. The spool may also include a locking or biasing mechanism, e.g., a switch, to prevent the cable from retracting when in the extended configuration and/or to facilitate in reeling the cable into the cavity when not desired for use.

Although a mirror-image-type configuration of each modular unit is depicted in the exemplary embodiment (including the recesses and apertures described herein above), it is understood that some embodiments may not be an exact mirror. For example, some embodiments may have differently shaped recesses on each side, or differently sized apertures. In yet other embodiments, additional connectors, cables, ports and the like may be provided on each modular unit.

To prevent the electrical plug 118 from being inadvertently pulled out of an adjacent plug recess 126, each modular unit may include a locking member 512 and release switch 200 (FIG. 5). In one embodiment, each electrical plug 118 may include a retention member coupled thereto, wherein the retention member is caught on a catch preventing the retention member and electrical plug 118 from being released. The catch may be spring-loaded and operably configured to move back-and-forth through use of a release switch exposed externally on the housing.

In other embodiments, the plug and recess may have a locking and corresponding tongue-and-groove configuration, whereby a user would insert and rotate the electrical plug 118 while in the plug recess 126 to prevent the retention member/plug from being removed. To remove the electrical plug 118, the user would rotate the electrical plug 118 in the opposite direction used to lock the plug within the recess 126.

To power on the outlet units, a unit activation switch 202 is electrically coupled to the first electrical socket 112, the second electrical socket 402, and the electrical plug 118. As shown in FIG. 4, the unit activation switch 202 is disposed on the electrical housing 104 for selectively translating between a first and second position. The first position closes a circuit with respect to the first electrical socket 112 and at least one of the second electrical socket 402 and the electrical plug 118. The second position opens the circuit with respect to the first electrical socket 112 and at least one of the second electrical socket 402 and the electrical plug 118. In this manner, the electrical current passes through the outlet units 102*a-n* in series. Furthermore, the unit activation switch 202 illuminates when in the second, or open, position. To help in regulating the electrical current, and illumination, the electrical plug on each of the plurality of selectively removably couplable outlet units further comprises a PCB 504 board. When multiple outlet units 102*a-n* are used, a second unit activation switch 203 may be operable on the second outlet unit 102*n*, whereby each outlet unit powers on and off independently of the other.

In one exemplary method of use, a first outlet unit 102*a* is placed in position for electrical connectivity. A user will pull the terminal end 120 of the electrical plug 118 out of the housing 103. The spool assembly creates a tension while the cord is being pulled out. The first electrical plug 118 may then be plugged into a wall outlet thereby electrically coupling the wall outlet to each electrical socket 112, 402 disposed on each individual unit coupled together through individual cords. Next, a second outlet unit 102*n* is positioned adjacently to the first outlet unit 102*a*. The electrical plug for the second outlet unit 102*n* is mated with the first electrical socket 112 or the second electrical socket 402 (See for example, FIG. 2). Subsequent outlet units 102*n* may also include a subsequent electrical socket 113 on the front face, as depicted in the first outlet unit 102*a*. Additional outlet units may then be connected in series in the same manner. Further, an external electrical device, or a USB cord may also be plugged into the electrical sockets for any of the outlet units.

Looking again at FIG. 4, the assembly 100 provides a pair of cantilevered plug fastening members 404*a*, 404*b* that are coupled to and extend away from the second end 400 of the electrical housing 104. The cantilevered plug fastening members 404*a-b* flank the second electrical socket 402, and are configured to directly couple with the electrical plug 118, creating a snug fastening mechanism that holds the electrical plug 118 into connectivity with the second electrical socket 402. In this manner, the cantilevered plug fastening members 404*a-b* clamp to the electrical plug 118, to maintain a stable connection with the second electrical socket 402. In one non-limiting embodiment, the pair of cantilevered plug fastening members 404*a-b* are flexible, creating a friction fit gripping effect. In another embodiment, a second outlet unit 102*n* has its own pair of cantilevered plug fastening members 404*c*, 404*d* for fastening subsequent electrical plugs in series.

Figure 12:
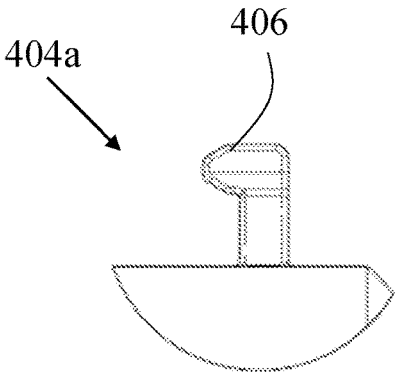
FIG. 12 is a side view of the cantilevered plug fastening members, in accordance with the present invention.

In one embodiment, the cantilevered plug fastening members 404*a-b* may have a flange 406 that clips onto the edge of the electrical plug 118 in a snap-fit relationship to maintain connectivity therewith. FIG. 12 is a side view of exemplary cantilevered plug fastening members 404*a-b* with flange 406. In one non-limiting embodiment, the flange 406 of each of the cantilevered plug fastening members 404*a-b* is disposed at the distal end thereof and is of a rounded shape. The flange 406 of each of the cantilevered plug fastening members 404*a-b* is operably configured to have a plug coupling configuration restricting longitudinal movement of the electrical plug 118 when coupled thereto.

In one embodiment shown in FIG. 1, an outer perimeter surface 130 surrounds the electrical plug 118, a first plug end 128*a*, a second plug end 128*b* opposing the first plug end 128*a*, and two plug recesses 126 corresponding in size to one another, and the flange 406 of each of the cantilevered plug fastening members 404*a-b*. Each plug recess 126 is disposed on first and second plug ends 106, 400, respectively, of the outer perimeter surface. In one non-limiting embodiment, the outer perimeter surface 130 that surrounds the electrical plug 118 is of a deformably resilient material.

The first electrical plug 118, which is plugged into the wall outlet, provides electrical current for all attached outlet units 102*a-n* that are coupled together through individual cords. Thereafter, a user may individually adjust one or more of the outlet units 102*a-n* to provide the desired length of the assembled modular unit assembly 100. Also, the user may add on more outlet units 102*a-n* or remove units as desired. The unique, modular arrangement of the outlet units 102*a-n* is possible because the electrical sockets 112, 402 are on different faces, the electrical cord 114 is extendable and retractable, and multiple outlet units 102*a-n* can be detachably mated with each other in different patterns and with different external electrical components.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A modular extendable outlet assembly comprising:

a plurality of selectively removably couplable outlet units each having:

an electrical housing with a first end, a second end opposing the first end, a front face, a rear face opposing the front face and having a mount wall, the electrical housing further having a sidewall enclosing, with the front and rear faces of the electrical housing, a unit cavity;

a first electrical socket defined by and disposed on the front face of the electrical housing;

a second electrical socket defined by and disposed on the second end of the electrical housing;

a plug cord aperture defined by and disposed on the first end of the housing;

a spool assembly disposed within the unit cavity and with a spring-loaded spool member;

an electrical cord coupled to and wrapped around the spring-loaded spool member, the electrical cord having a portion disposed within the plug cord aperture and including an electrical plug disposed at a terminal end of the electrical cord, the electrical plug having an electrical prong configuration corresponding to a prong configuration of the second electrical socket, and electrically coupled to the first electrical socket and the second electrical socket; and a cord release switch disposed on the sidewall of the electrical housing, operably coupled to the spring-loaded spool member, and operably configured to have the electrical cord in a retracted configuration along a cable path and to selectively translate to an extended configuration and cause the spring-loaded spool member to rotate and to permit extension in length of the electrical cord a distance from the electrical housing, wherein each of the plurality of selectively removably couplable outlet units are operably configured to be selectively and independently electrically couplable, extendable, and retractable with respect to one another, the electrical prong configuration faces in a perpendicular orientation with respect to the first electrical socket when then electrical cord is in the retracted configuration, and with the electrical plug centrally aligned with the first electrical socket and the second electrical socket when then electrical cord is in the retracted configuration.

2. The modular extendable outlet assembly according to claim 1, wherein each of the plurality of selectively removably couplable outlet units further comprise:

a unit activation switch electrically coupled to the first electrical socket, the second electrical socket, and the electrical plug, the unit activation switch disposed on the electrical housing and operably configured to selectively translate to a first position closing a circuit with respect to the first electrical socket and at least one of the second electrical socket and the electrical plug and a second position opening a circuit with respect to the first electrical socket and at least one of the second electrical socket and the electrical plug.

3. The modular extendable outlet assembly according to claim 2, wherein:

the unit activation switch illuminates when in the second position.

4. The modular extendable outlet assembly according to claim 1, wherein each of the plurality of selectively removably couplable outlet units further comprise:

a pair of cantilevered plug fastening members coupled to and extending away from the second end of the electrical housing, the pair of cantilevered plug fastening members flanking the second electrical socket, the pair of cantilevered plug fastening members operably configured to directly couple with the electrical plug.

5. The modular extendable outlet assembly according to claim 4, wherein each of the pair of cantilevered plug fastening members further comprise:

a flange disposed at the distal end of the pair of cantilevered plug fastening members.

6. The modular extendable outlet assembly according to claim 5, wherein the electrical plug on each of the plurality of selectively removably couplable outlet units further comprises:

an outer perimeter surface surrounding the electrical plug, a first plug end, a second plug end opposing the first plug end, and two plug recesses corresponding in size to one another and the flange of each of the pair of cantilevered plug fastening member and each disposed on first and second plug ends, respectively, of the outer perimeter surface.

7. The modular extendable outlet assembly according to claim 6, wherein:

the flange of each of the pair of cantilevered plug fastening members is operably configured to have a plug coupling configuration restricting longitudinal movement of the electrical plug when coupled thereto.

8. The modular extendable outlet assembly according to claim 7, wherein:

the pair of cantilevered plug fastening members are flexible.

9. The modular extendable outlet assembly according to claim 1, wherein:

the outer perimeter surface surrounding the electrical plug is of a deformably resilient material.

10. The modular extendable outlet assembly according to claim 1, wherein the electrical plug on each of the plurality of selectively removably couplable outlet units further comprises:

a PCB board.

11. The modular extendable outlet assembly according to claim 1, wherein the front face of the electrical housing comprises:

a USB port.

12. The modular extendable outlet assembly according to claim 1, wherein the first electrical socket and the second electrical socket comprises:

a USA standard 3 prong outlet.

13. The modular extendable outlet assembly according to claim 1, wherein the electrical plug comprises:

a USA standard 3 prong female plug.

14. The modular extendable outlet assembly according to claim 1, wherein the mount wall comprises:

one or more holes for hanging each individual outlet unit.

15. The modular extendable outlet assembly according to claim 1, wherein the spring-loaded spool member comprises:

a ratchet wheel.

16. The modular extendable outlet assembly according to claim 1, wherein:

the electrical housing is separable into a first housing portion and a second housing portion, the housing portions being detachably attachable through a housing fastening bracket.

17. The modular extendable outlet assembly according to claim 1, wherein the sidewall of the electrical housing further comprises:

a cavity defined by the sidewall of the electrical housing and including the plug cord aperture, wherein the electrical plug is disposed at least partially within the cavity when then electrical cord is in the retracted configuration.

18. The modular extendable outlet assembly according to claim 17, wherein:

the electrical plug is visually concealed within the cavity when then electrical cord is in the retracted configuration.

19. A modular extendable outlet assembly comprising:

a plurality of selectively removably couplable outlet units each having:

an electrical housing with a first end, a second end opposing the first end, a front face, a rear face opposing the front face and having a mount wall, the electrical housing further having a sidewall enclosing, with the front and rear faces of the electrical housing, a unit cavity;

a first electrical socket defined by and disposed on the front face of the electrical housing;

a second electrical socket defined by and disposed on the second end of the electrical housing;

a plug cord aperture defined by and disposed on the first end of the housing;

a spool assembly disposed within the unit cavity and with a spring-loaded spool member;

an electrical cord coupled to and wrapped around the spring-loaded spool member, the electrical cord having a portion disposed within the plug cord aperture and including an electrical plug disposed at a terminal end of the electrical cord, the electrical plug having an electrical prong configuration corresponding to a prong configuration of the second electrical socket, and electrically coupled to the first electrical socket and the second electrical socket;

a pair of cantilevered plug fastening members coupled to and extending away from the second end of the electrical housing, the pair of cantilevered plug fastening members flanking the second electrical socket, the pair of cantilevered plug fastening members operably configured to directly couple with the electrical plug;

a cord release switch disposed on the electrical housing, operably coupled to the spring-loaded spool member, and operably configured to selectively translate and cause the spring-loaded spool member to rotate and to permit extension in length of the electrical cord a distance from the electrical housing, wherein each of the plurality of selectively removably couplable outlet units are operably configured to be selectively and independently electrically couplable, extendable, and retractable with respect to one another; and a unit activation switch electrically coupled to the first electrical socket, the second electrical socket, and the electrical plug, the unit activation switch disposed on the electrical housing and operably configured to selectively translate to a first position closing a circuit with respect to the first electrical socket and at least one of the second electrical socket and the electrical plug and a second position opening a circuit with respect to the first electrical socket and at least one of the second electrical socket and the electrical plug, the unit activation switch illuminating when in the second position.

20. A modular extendable outlet assembly comprising:

a plurality of selectively removably couplable outlet units each having:

an electrical housing with a first end, a second end opposing the first end, a front face, a rear face opposing the front face and having a mount wall, the electrical housing further having a sidewall enclosing, with the front and rear faces of the electrical housing, a unit cavity;

a first electrical socket defined by and disposed on the front face of the electrical housing;

a second electrical socket defined by and disposed on the second end of the electrical housing;

a plug cord aperture defined by and disposed on the first end of the housing;

a spool assembly disposed within the unit cavity and with a spring-loaded spool member;

an electrical cord coupled to and wrapped around the spring-loaded spool member, the electrical cord having a portion disposed within the plug cord aperture and including an electrical plug disposed at a terminal end of the electrical cord, the electrical plug having an electrical prong configuration corresponding to a prong configuration of the second electrical socket, and electrically coupled to the first electrical socket and the second electrical socket;

an outer perimeter surface surrounding the electrical plug, a first plug end, a second plug end opposing the first plug end, and two plug recesses corresponding in size to one another and the flange of each of the pair of cantilevered plug fastening member and each disposed on first and second plug ends, respectively, of the outer perimeter surface;

a pair of cantilevered plug fastening members coupled to and extending away from the second end of the electrical housing, the pair of cantilevered plug fastening members flanking the second electrical socket, the pair of cantilevered plug fastening members operably configured to directly couple with the electrical plug, the pair of cantilevered plug fastening members having a flange that is operably configured to have a plug coupling configuration restricting longitudinal movement of the electrical plug when coupled thereto;

a cord release switch disposed on the sidewall of the electrical housing, operably coupled to the spring-loaded spool member, and operably configured to selectively translate and cause the spring-loaded spool member to rotate and to permit extension in length of the electrical cord a distance from the electrical housing, wherein each of the plurality of selectively removably couplable outlet units are operably configured to be selectively and independently electrically couplable, extendable, and retractable with respect to one another; and a unit activation switch electrically coupled to the first electrical socket, the second electrical socket, and the electrical plug, the unit activation switch disposed on the electrical housing and operably configured to selectively translate to a first position closing a circuit with respect to the first electrical socket and at least one of the second electrical socket and the electrical plug and a second position opening a circuit with respect to the first electrical socket and at least one of the second electrical socket and the electrical plug, the unit activation switch illuminating when in the second position.

* * * * *